US007151211B2

(12) United States Patent
Whittington et al.

(10) Patent No.: US 7,151,211 B2
(45) Date of Patent: Dec. 19, 2006

(54) SNARE DRUM ADJUSTABLE DAMPENING DEVICE

(76) Inventors: Christopher Joesph Whittington, 28101 Industry Dr., Valencia, CA (US) 91355; Louis Charles Cavallaro, Jr., 28101 Industry Dr., Valencia, CA (US) 91355

( * ) Notice: Subject to any disclaimer, the term of this patent is extended or adjusted under 35 U.S.C. 154(b) by 100 days.

(21) Appl. No.: 11/121,237

(22) Filed: May 4, 2005

(65) Prior Publication Data

US 2006/0249006 A1 Nov. 9, 2006

(51) Int. Cl.
*G10D 13/02* (2006.01)

(52) U.S. Cl. ..... 84/415

(58) Field of Classification Search ..... 84/415, 84/417

See application file for complete search history.

(56) References Cited

U.S. PATENT DOCUMENTS 3,113,481 A * 12/1963 Thompson ..... 84/415
4,018,130 A * 4/1977 Gariepy, Sr. ..... 84/415

* cited by examiner

*Primary Examiner*—Kimberly Lockett

(74) *Attorney, Agent, or Firm*—Larry F. Gitlin

(57) ABSTRACT

A device for dampening sounds produced by a drumhead of a musical drum having a drumshell comprising a frame assembly having a first elongated bar member with a first channel and a second elongated bar member with a second channel. The two bar members are disposed in opposed spaced apart parallel relation. Mounting brackets are affixed and secured to the two bar members at their opposing ends. Attached, respectively, to the two mounting brackets between the two bar members are the opposing ends of an assembly of snare wires. The mounting brackets are also provided to connect the assembly to the drumshell and are vertically adjustable between a high tension position such that the snare wires are moved to press against the drumhead and a lower tension position in which the wires are caused to relax to enable the release of tension of the wires against the drumhead. The dampening member has end components adapted to fit slidably into the first and second channels, respectively, to enable the dampening member to be movable between the two elongated bar members along the frame assembly in physical contact with the snare wires to adjust the tension of the wires against the drumhead to produce a variety of sounds. The dampening member is comprised of a base member, a device for physically contacting the snare wires as it is moved along the frame assembly and a resilient material situated between the base member and the contact device to buffer vibrations produced by the struck drumhead.

9 Claims, 6 Drawing Sheets

SNARE DRUM ADJUSTABLE DAMPENING DEVICE

BACKGROUND OF THE INVENTION

1. Field of the Invention

The present invention relates generally to the field of musical instruments and, more particularly, to an improved device for dampening the sounds produced by the drumhead of a musical drum.

2. Description of the Prior Art

Snare drums have unique characteristics that make them very different from a bass drum, tom-tom drum and various other conventional, modern and ethnic drums. Typical snare drums consists of a hollow body or shell with a drumhead covering either the top opening or both the top and bottom openings. The head that is struck by a drumstick or the like is called the batter head. Secured to the inside of the drumshell beneath the batter head is a snare assembly fashioned primarily of a plurality of wire strands held near or against the underside or inside surface of the batter head.

In order to vary the sounds produced by snare drums, a variety of devices or assemblies are provided to force or press the snare wire against the batter head to produce the desired sounds. These devices, which are usually structurally complex or cumbersome and/or often not very effective, include, for example, the devices disclosed and claimed in U.S. Pat. No. 6,307,133; U.S. Pat. No. 6,586,664 and U.S. Pat. No. 6,091,010.

A search of the prior art has not disclosed any patents or published applications that read directly on the claims of the present invention. However, the following references, which also include the aforesaid U.S. patents, are considered relevant:

| U.S. Pat. No. | Inventor | Issue Date |
|---|---|---|
| 6,091,010 | Gary L. Gauger | Jul. 18, 2000 |
| 6,177,620 | Moris Alulyan | Jan. 23, 2001 |
| 6,307,133 | James H. May et al. | Oct. 23, 2001 |
| 6,534,698 | Yoshihiro Hoshino | Mar. 18, 2003 |
| 6,586,664 | Francis P. Hubbell | Jul. 1, 2003 |
| 6,700,046 | Wahan Cherbettchian | Mar. 2, 2004 |

None of the devices in the prior art, including the aforesaid, teaches a snare drum dampening device with the improvements of the present invention, specifically a device which adjusts and varies the sounds of the snare batter head by incrementally moving the device slidably along parallel spaced apart elongated bars in contact relation with the snare wires to tension the wires against the drumhead.

SUMMARY OF THE INVENTION

In its preferred embodiment, the present invention provides a device for dampening sounds produced by a drumhead of a musical drum having a drumshell. The device comprises a frame assembly having a first elongated bar member with a first channel integrally formed therein and a second elongated bar member having a second channel integrally formed therein. The two bar members are disposed in opposed spaced apart parallel relation. Identical mounting brackets are affixed and secured to the two bar members at their opposing ends. Attached, respectively, to the two mounting brackets between the two bar members are the opposing ends of an assembly of snare wires.

Also provided is a dampening means, which includes ends adapted to fit slidably into the first and second integrally formed channels, respectively, to enable the dampening means to be longitudinally movable between the two elongated bar members along the frame assembly in physical contact with the snare wires to adjust the tension of the wire against the drumhead producing a variety of sounds in the process.

The dampening means is comprised of a mounting base member, a device for physically contacting the snare wire as the device is moved longitudinally along the frame assembly and a resilient material situated between the mounting base member and the contact device to buffer vibrations produced by the struck drumhead.

The mounting brackets, in addition to their function to join and secure the snare wires and the two elongated bar members to form the frame assembly, are also provided to join the assembly to the drumshell. The mounting brackets, which incorporate slotted openings, are vertically adjustable between an elevated high tension position such that the snare wire strands are moved to press firmly against the underside or inside surface of the drumhead and a lower tension position in which the wire strands are caused to relax to enable the release of tension of the wire strands against the drumhead.

Accordingly, it is an object of the present invention to provide an improved device for dampening the sounds produced by the drumhead of a musical drum.

It is also an object of the present invention to provide an improved device for dampening the sounds produced by the drumhead of a musical drum which adjusts and varies the sounds of a snare drum batter head by incrementally moving the device slidably along spaced apart elongated bars in contact relation with the snare wires.

It is also an object of the present invention to provide an improved device for dampening the sounds produced by the drumhead of a musical drum that is uncomplicated in structure and easy to adjust between a high tension position, with the dampening device pushing the snare wires firmly against the underside or inside surface of the batter head, and a lower tension position, with the dampening device releasing pressure against the snare wires to enable the release of tension of the snare wires against the drumhead.

It is also an object of the present invention to provide an improved device for dampening the sounds produced by the drumhead of a musical drum that is easy to use.

It is also an object of the present invention to provide an improved device for dampening the sounds produced by the drumhead of a musical drum that is relatively inexpensive to manufacture.

Other objects and advantages of the present invention will become apparent in the following specifications when considered in light of the attached drawings wherein the preferred embodiment of the invention is illustrated.

DETAILED DESCRIPTION OF THE PREFERRED EMBODIMENT

Figure 1:
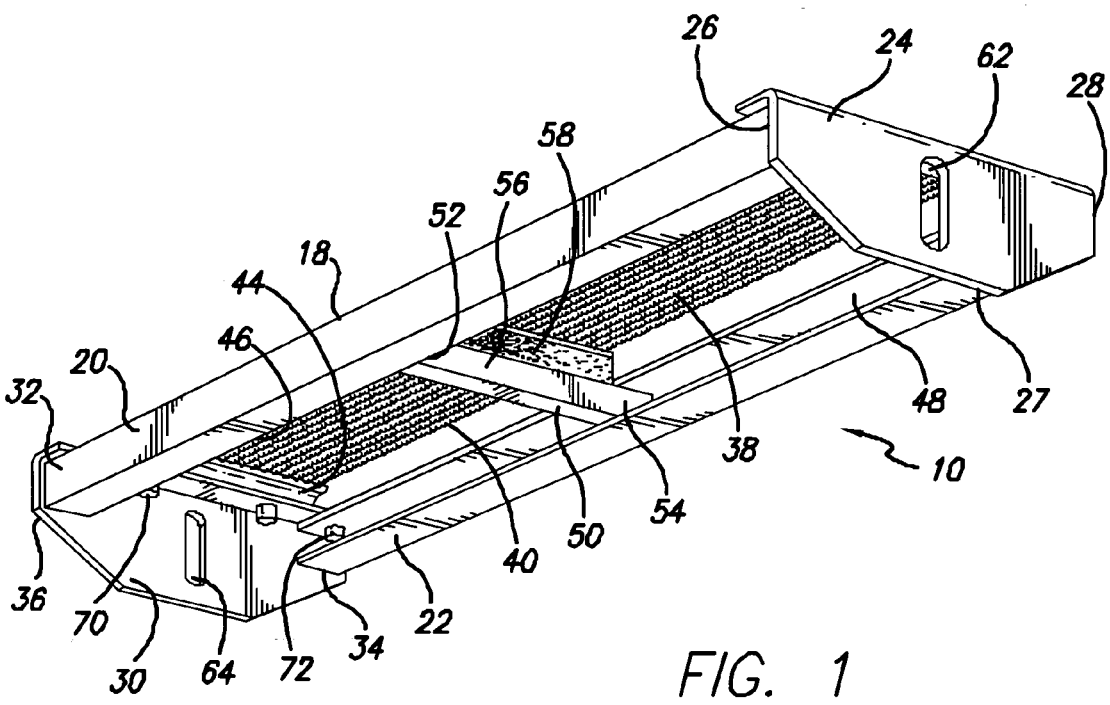
FIG. 1 is a perspective view of the snare drum dampening device in accordance with the present invention.
Figure 3:
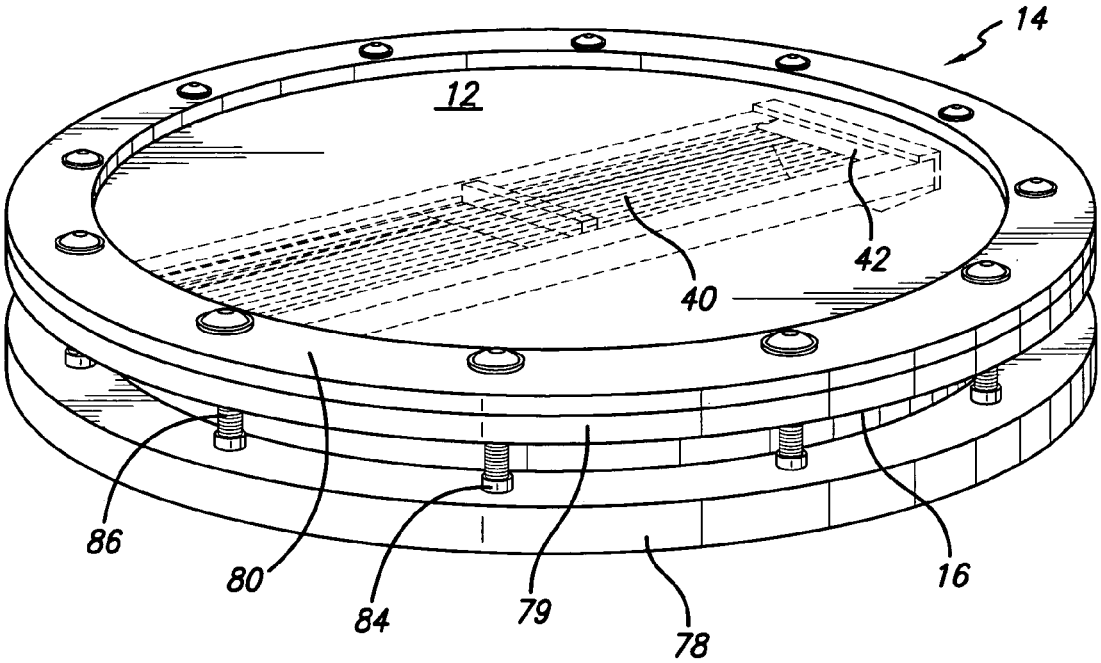
FIG. 3 is a perspective view of a musical drum with the snare drum dampening device shown in phantom mounted beneath the underside of the batter head of a drum in accordance with the present invention.

Referring more particularly to the drawings, FIG. 1 is a perspective view of the preferred embodiment of the present invention depicting a device 10 for dampening sounds produced by the drumhead 12 of a musical drum 14 having a drumshell 16, as shown in FIG. 3. Device 10 includes a frame assembly 18 having an elongated bar 20 on one side and an elongated bar 22 extending in opposed parallel relation on the other. Mounting bracket 24 is affixed to end 26 of bar 20 and end 27 of bar 22 at end 28 of frame assembly 18. Mounting bracket 30 is affixed to end 32 of bar 20 and end 34 of bar 22 at end 36 of frame assembly 18. Strands of wire 38, usually helical shaped, comprising snare 40 are positioned between bar 20 and bar 22 and secured to mounting brackets 24, 30 at end plates 42, 44, respectively. Formed within bars 20, 22 are elongated channels 46, 48, respectively, extending the entire length of each bar.

A dampening member 50 with ends 52, 54 adapted to fit slidably into channels 46, 48, respectively, is moved along frame assembly 18 between bars 20, 22 either in a forward or backward direction in contact relation with snare 40 to adjust the tension of wire strands 38 against drumhead 12 to produce a variety of desired drum sounds. Member 50 is comprised of a mounting base 56, contact 58 for engaging wire strands 38 as member 50 is moved along snare 40, and buffer 60 secured between mounting base 56 and contact 58 to soften or lessen the vibrations produced when drumhead 12 is struck by an object, such as, for example, a drum stick (not shown) or when member 50 experiences heavy usage.

Formed within mounting bracket 24 is vertical slot 62 and similarly formed within mounting bracket 30 is vertical slot 64. Slots 62, 64 are used in combination with mating wing nuts 66 and screws 68 to affix-frame assembly 18 to drumshell 16 enabling device 10 to adjust vertically between an elevated high tension position such that wire strands 38 are engaged by member 50 to press against drumhead 12, and a lower tension position such that wire strands 38 are relaxed upon the release of tension of wire strands 38 against drumhead 12.

The components of frame assembly 18, such as, for example, brackets 24, 30, bars 20, 22 and strands of wire 38 at end plates 42, 44 are assembled and secured using a variety of suitable fastening devices, which include, without limitation, countersunk flathead rivets 70, flathead screws 72 in addition to wing nuts 66 and screws 68 already referred to.

In application, frame assembly 18 is attached and secured to the inside (or the outside of the shell if desired) of drumshell 16 using the combination of wing nuts 66 and flathead screws 68, as shown. By loosening these connections to allow them to slide up and down vertical slots 62, 64, and then fastening them as necessary, frame assembly 18 can be adjusted according to the degree of tension desired against snare 40. Member 50 is then moved along frame assembly 18 between bars 20, 22 to the point where tension against drumhead 12 is desired and then either left there while the instrument is being played or adjusted intermittently to produce a variety of different sounds.

Figure 2:
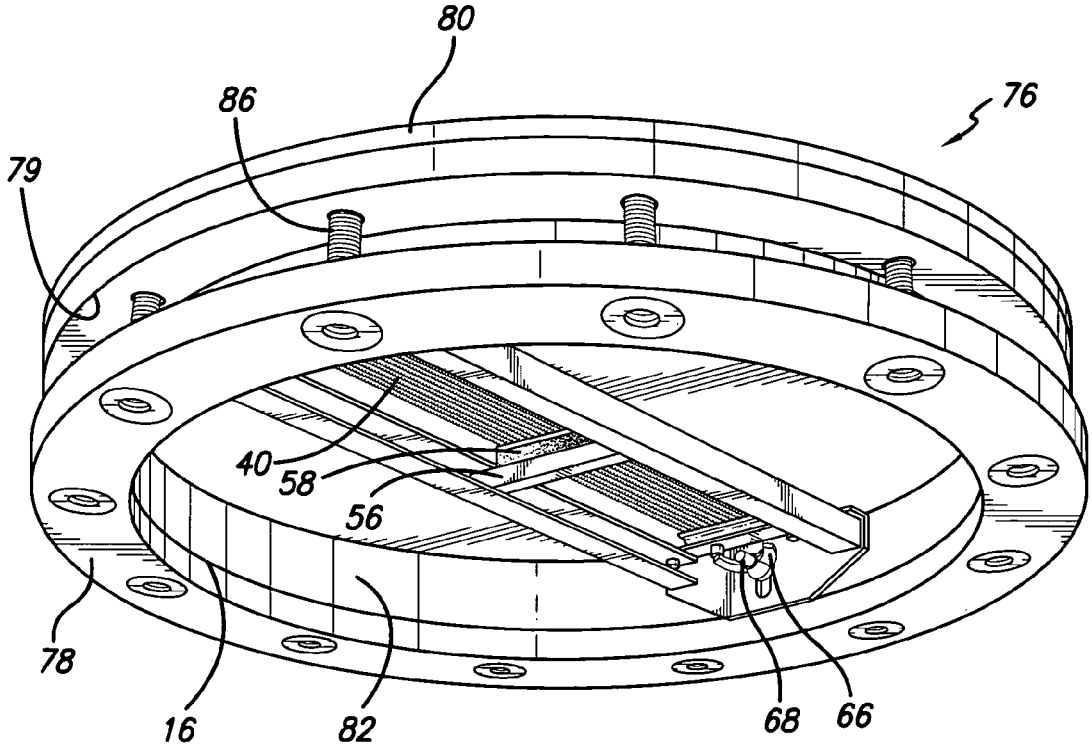
FIG. 2 is a perspective view of the snare drum dampening device mounted inside a drum shell in accordance with the present invention.
Figure 4:
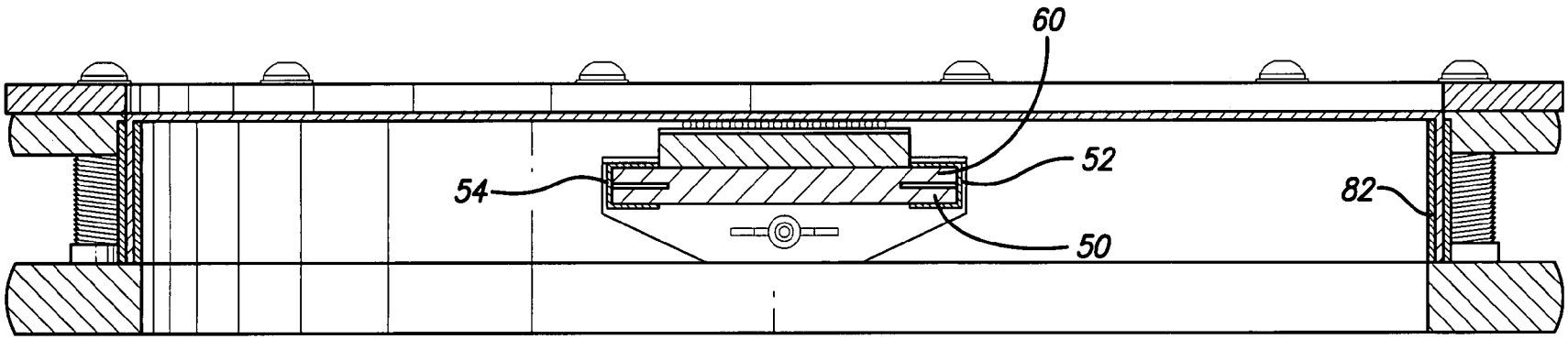
FIG. 4 is a sectional view of the snare drum dampening device mounted inside a drumshell in accordance with the present invention.
Figure 5:
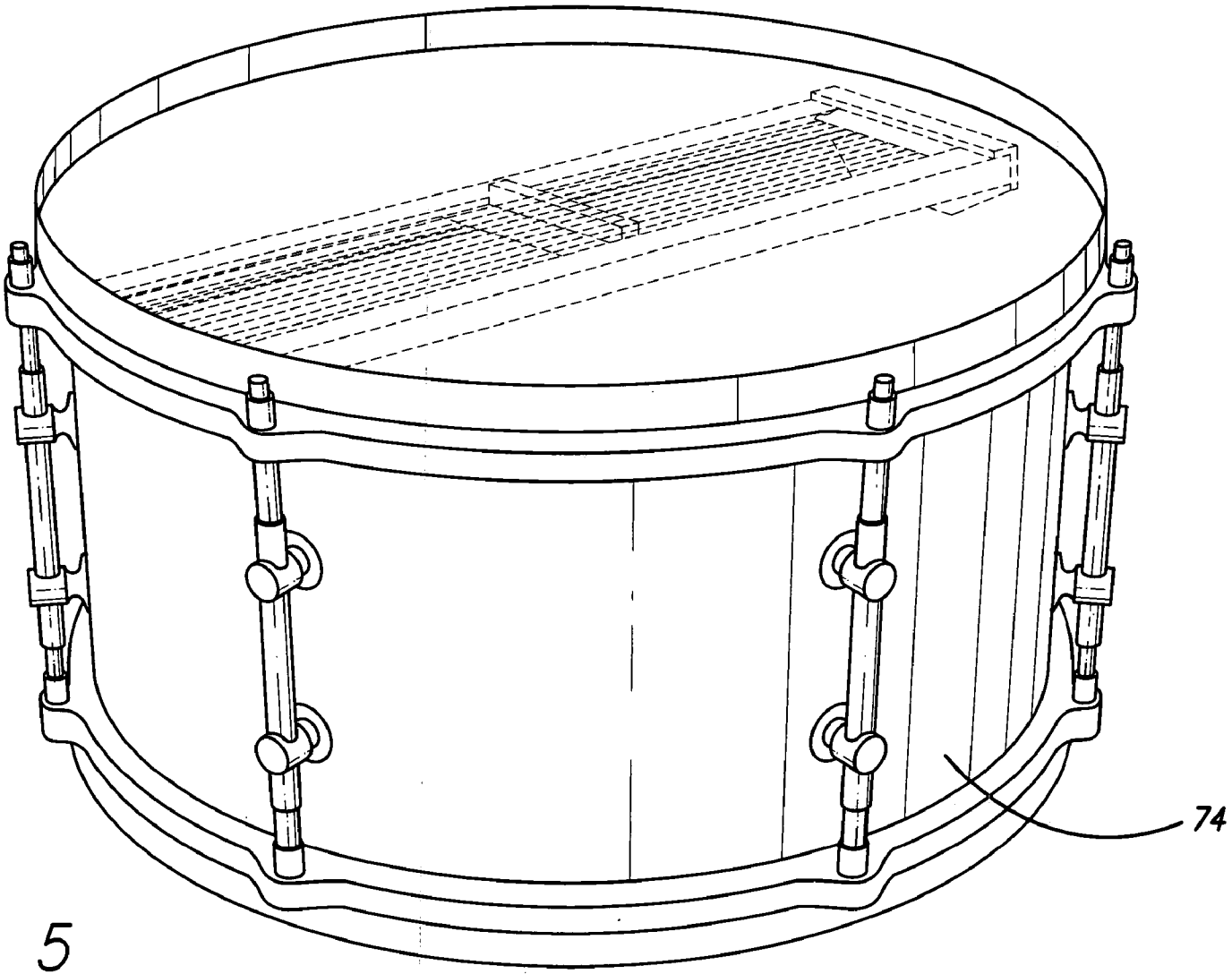
FIG. 5 is a perspective view of the snare drum dampening device shown in phantom mounted inside a conventional embodiment of a musical drum shell in accordance with the present invention.
Figure 6:
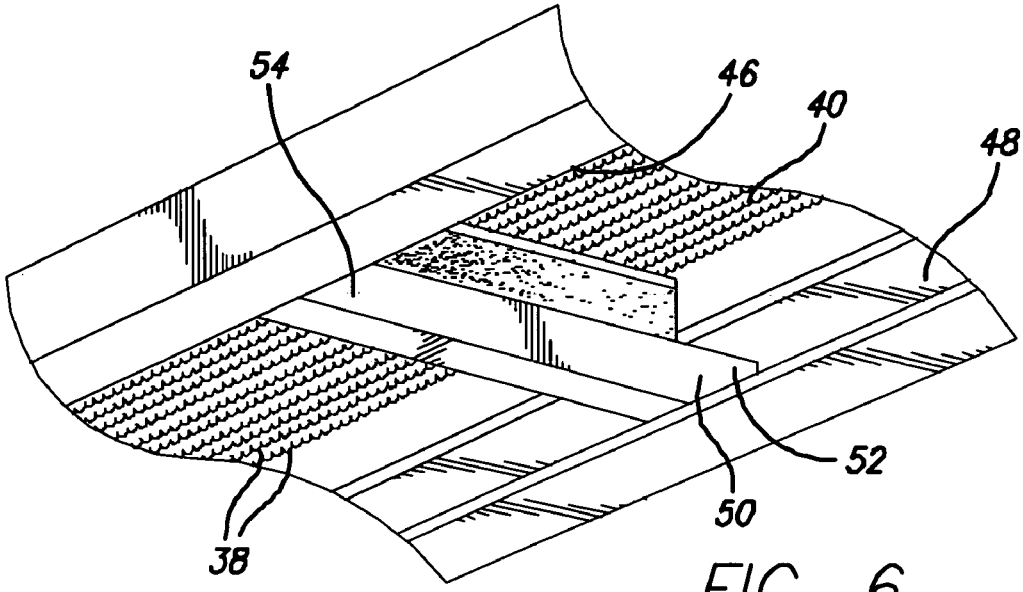
FIG. 6 is an enlarged sectional view of the snare drum dampening device in accordance with the present invention.
Figure 7:
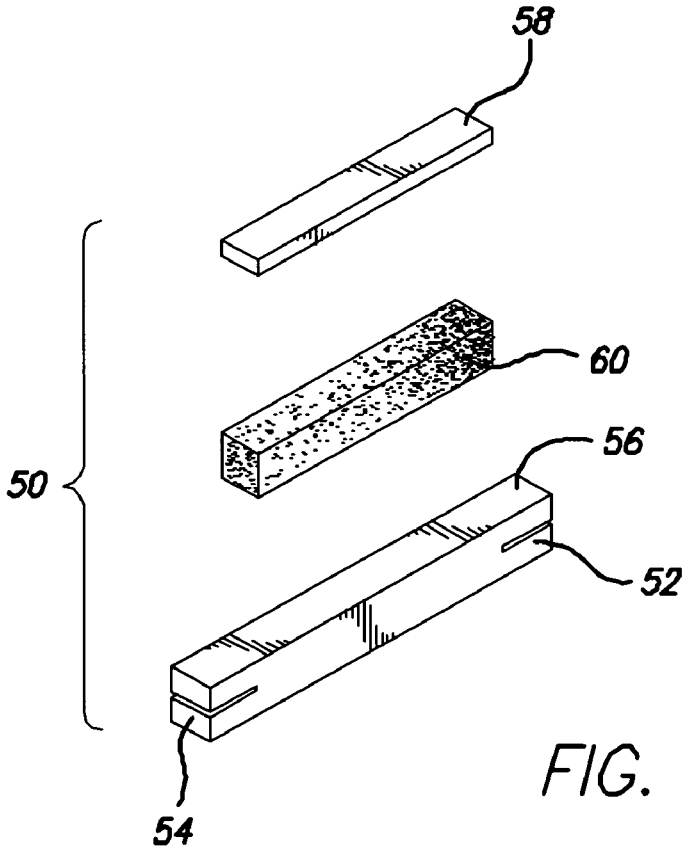
FIG. 7 is an exploded view of the components of the dampening member of the snare drum dampening device in accordance with the present invention.

Device 10 can have application in a variety of contexts including, without limitation, in combination with a more conventional drumshell 74, as shown in FIG. 5, or in combination with a more cutting edge advancement in drum design, such as the instrument 76 shown in FIGS. 2–4. Instrument 76 is comprised of rings 78, 79 and hoop 80 in combination with shell 16 and drumhead 12, which are assembled and secured with a series of nuts 84 and bolts 86 to construct the instrument and tension the head.

Frame assembly 18, including all of its components, as described heretofore, are typically fabricated of a metal alloy, though any suitable material may be used. The present invention, including all of its components, and the musical drums used in combination therewith, are not limited to any specific dimension, material or even shape, or any means or method of assembly, so long as intended objective is achieved.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

The invention claimed is:

1. A device for dampening sounds produced by a drumhead of a musical drum having a drumshell, comprising:

a frame assembly having a first elongated bar member with a first channel integrally formed therein and a second elongated bar member with a second channel integrally formed therein, said first elongated bar member and said second elongated bar member disposed in opposed spaced apart relation, a first mounting bracket and a second mounting bracket affixed and secured to the opposing ends of said first elongated bar member and said second elongated bar member, respectively, a snare assembly having a plurality of wire strands placed in parallel relation to said first and second elongated bar members and secured at opposite ends of said snare assembly to said first mounting bracket and said second mounting bracket, respectively, a dampening member having ends adapted to fit slidably into said first channel and said second channel, respectively, to enable said dampening member to be longitudinally movable between said first and second elongated bar members along said frame assembly in contact relation with said wire strands to adjust the tension of said wire strands against the drumhead to produce a variety of sounds.

2. The device for dampening sounds as recited in claim 1 wherein said dampening member is comprised of a base member, a device for contacting said wire strands as it is moved longitudinally along said frame assembly between said first and second elongated bar members and a member secured between said base member and said contact device to buffer vibrations produced by the struck drumhead.

3. The device for dampening sounds as recited in claim 1 wherein said first mounting bracket and said second mounting bracket affix said frame assembly to said drumshell.

4. The device for dampening sounds as recited in claim 2 wherein said first mounting bracket and said second mounting bracket are vertically adjustable between an elevated high tension position wherein said wire strands are moved to press against the underside of the drumhead and a lower tension position wherein said wire strands are relaxed upon the release of tension of said wire strands against the drumhead.

5. The device for dampening sounds as recited in claim 2 wherein said contact device is comprised of a synthetic material.

6. The device for dampening sounds as recited in claim 2 wherein said contact device is comprised of Mylar®.

7. The device for dampening sounds as recited in claim 2 wherein said buffer member is comprised of a foam material.

8. The device for dampening sounds as recited in claim 1 having a plurality of dampening members.

9. A device for dampening sounds produced by a drumhead of a musical drum, comprising:

a frame assembly having a first elongated bar member with a first channel and a second elongated bar member with a second channel, said first elongated bar member and said second elongated bar member disposed in opposed spaced apart relation, a first mounting bracket and a second mounting bracket affixed and secured to the opposing ends of said first elongated bar member and said second elongated bar member, respectively, a snare assembly having a plurality of wire strands placed in substantial parallel relation to said first and second elongated bar members and secured at opposite ends of said snare assembly to said first mounting bracket and said second mounting bracket, respectively, a dampening member having ends adapted to fit slidably into said first channel and said second channel, respectively, to enable said dampening member to be movable along said frame assembly in contact relation with said wire strands to adjust the tension of said wire strands against the drumhead to produce a variety of sounds.

* * * * *

UNITED STATES PATENT AND TRADEMARK OFFICE

CERTIFICATE OF CORRECTION

PATENT NO. : 7,151,211 B2
APPLICATION NO. : 11/121237
DATED : December 19, 2006
INVENTOR(S) : Christopher Joseph Whittington and Lous Charles Cavallaro, Jr.

It is certified that error appears in the above-identified patent and that said Letters Patent is hereby corrected as shown below:

On the title page

Item 73: Please add Assignee: Remo, Inc.
28101 Industry Drive
Valencia, CA 91355

Signed and Sealed this

Nineteenth Day of June, 2007

JON W. DUDAS
*Director of the United States Patent and Trademark Office*